US005761852A

United States Patent [19]

Liu

[11] Patent Number: 5,761,852

[45] Date of Patent: Jun. 9, 1998

[54] SHIELDING DEVICE WITH INFLATABLE FRAME STRUCTURE

[76] Inventor: Chang Hsiung Liu, No. 8, Shang 4 Fu, Yang-Mei Town, Yao-Yuan Hsien, Taiwan

[21] Appl. No.: 691,706

[22] Filed: Aug. 2, 1996

[51] Int. Cl.[6] ..... E04B 1/343; E04B 15/20; A63H 33/08

[52] U.S. Cl. ..... 52/2.18; 52/2.13; 52/2.22; 446/85; 446/220; 446/478

[58] Field of Search ..... 446/85, 220, 221, 446/223, 478

[56] References Cited

U.S. PATENT DOCUMENTS

| | | | |
|---|---|---|---|
| 3,994,102 | 11/1976 | Johnson et al. | 446/220 |
| 4,631,873 | 12/1986 | Parish | 52/2 |
| 4,901,481 | 2/1990 | Seeley, Jr. | 52/2 |
| 4,979,532 | 12/1990 | Johansson et al. | 135/97 |
| 5,007,212 | 4/1991 | Fritts et al. | 52/2.18 |
| 5,145,440 | 9/1992 | Boris et al. | 446/106 |
| 5,247,768 | 9/1993 | Russo | 52/2.13 |
| 5,570,544 | 11/1996 | Hale et al. | 52/2.18 |

FOREIGN PATENT DOCUMENTS

| | | | |
|---|---|---|---|
| 345600 | 12/1989 | European Pat. Off. | 52/2.18 |
| 14957 | 8/1894 | United Kingdom | 446/221 |
| 2043737 | 10/1980 | United Kingdom | 52/2.18 |

*Primary Examiner*—Robert A. Hafer
*Assistant Examiner*—Laura Fossum
*Attorney, Agent, or Firm*—Bacon & Thomas

[57] ABSTRACT

A shielding device including an inflatable frame structure, and a covering covered over the inflatable frame structure, the inflatable frame structure including a plurality of inflatable purlins, and a plurality of inflatable rafters connected in parallel by the inflatable purlins, the inflatable purlins and the inflatable rafters having a respective air valve, each inflatable rafter having a plurality of coupling portions adapted for coupling to the inflatable purlins, each coupling portion defining a coupling hole through which one inflatable purlin is inserted.

3 Claims, 9 Drawing Sheets

SHIELDING DEVICE WITH INFLATABLE FRAME STRUCTURE

BACKGROUND OF THE INVENTION

The present invention relates to toy shields, and relates more particularly to such a toy shielding device which has an inflatable frame structure formed by connecting inflatable rafters and inflatable purlins together.

FIG. 1 shows a toy shielding device according to the prior art. This structure of toy shielding device 1 is comprised of a frame structure formed by connecting a plurality of metal tubes 11, straight tube connectors 12, angle connectors 13, and Y-connectors 14 together, and a covering 15 covered over the frame structure. This structure of toy shielding device has numerous drawbacks. When the toy shielding device is collapsed, the connectors 12, 13, 14 must be carefully collected and stored. If any connector is missed, the toy shielding device become unable to be set up. Another drawback of this structure of toy shielding device is its heavy weight. Because the frame tubes of the frame structure are made from metal, the toy shielding device is not convenient for carrying by hand when collapsed. Still another drawback of this structure of toy shielding device is that the children tend to be injured by the metal parts of the frame structure during the assembly process. Furthermore, the toy shielding device will become unable to be set up if any of the metal tubes is deformed.

SUMMARY OF THE INVENTION

The present invention has been accomplished to provide a shielding device which eliminates the aforesaid drawbacks. It is one object of the present invention to provide a shielding device which can be conveniently set up without the use of any connectors. It is another object of the present invention to provide a shielding device which has an inflatable frame structure that can be collapsed into a flat manner and then folded up to diminish the size. According to one embodiment of the present invention, the shielding device comprises an inflatable frame structure, and a covering covered over the inflatable frame structure. The inflatable frame structure comprises a plurality of inflatable purlins, and a plurality of inflatable rafters connected in parallel by the inflatable purlins, the inflatable purlins and the inflatable rafters having a respective air valve, each inflatable rafter having a plurality of coupling portions adapted for coupling to the inflatable purlins, each coupling portion defining a coupling hole through which one inflatable purlin is inserted.

DETAILED DESCRIPTION OF THE PREFERRED EMBODIMENT

Figure 1:
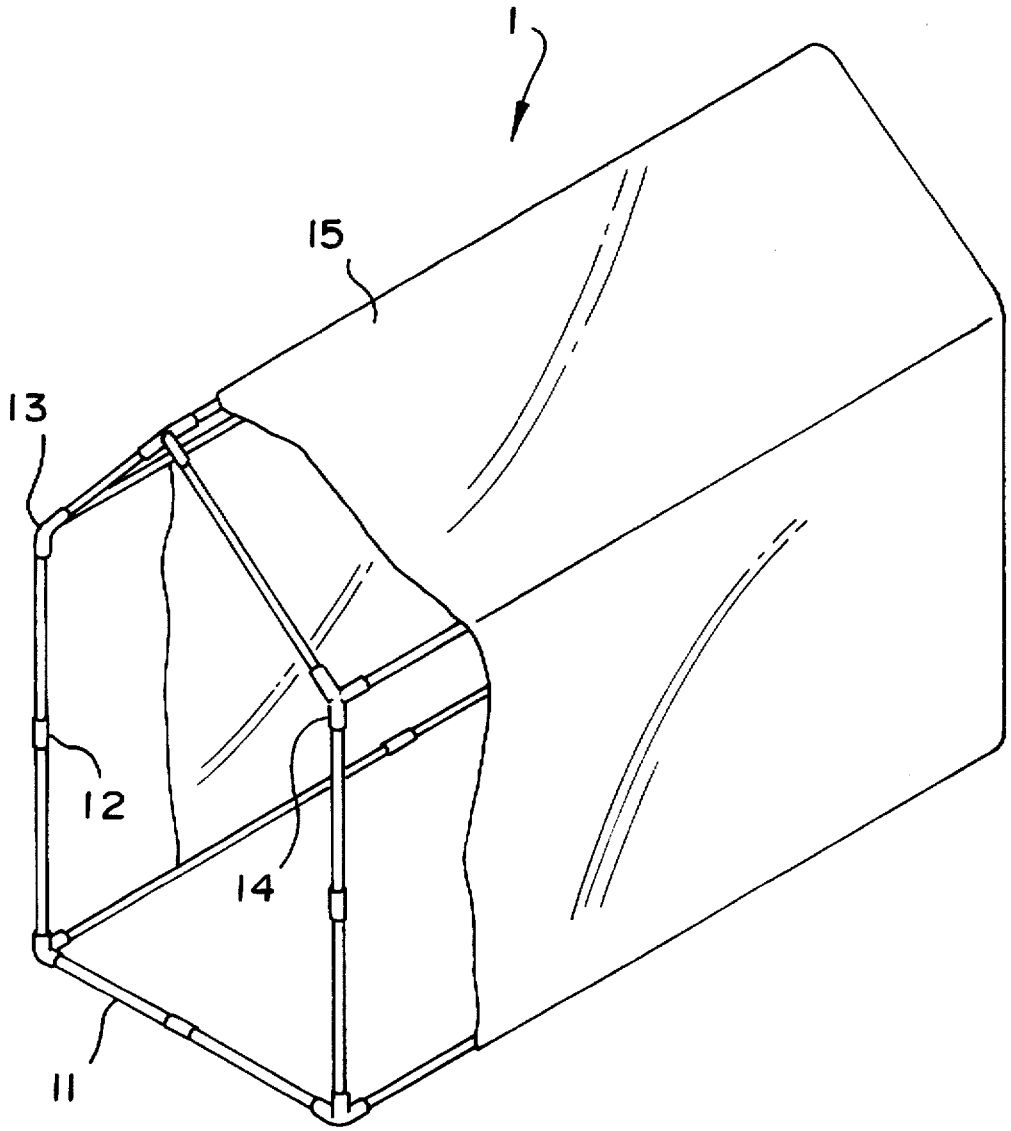
FIG. 1 PRIOR ART
FIG. 1 is a cutaway view of a toy shielding device according to the prior art.
Figure 2:
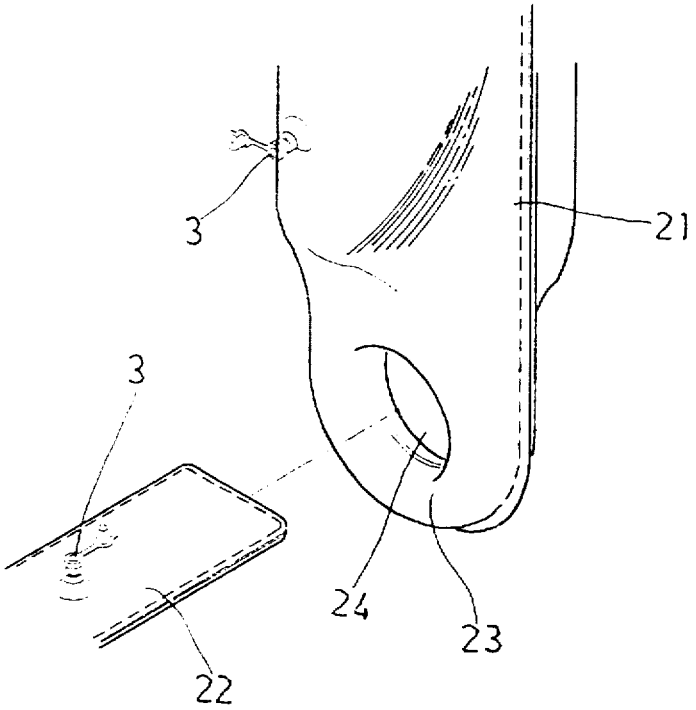
FIG. 2 shows one inflatable purlin and one inflatable rafter according to the present invention.
Figure 3:
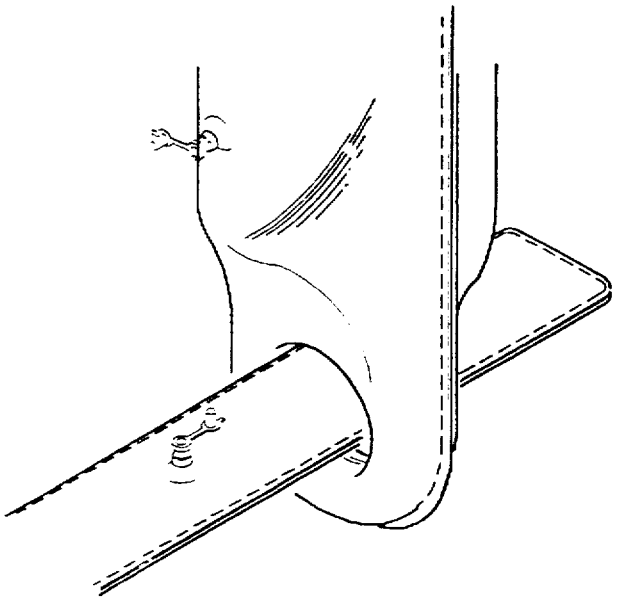
FIG. 3 is an assembly view of FIG. 2.
Figure 4:
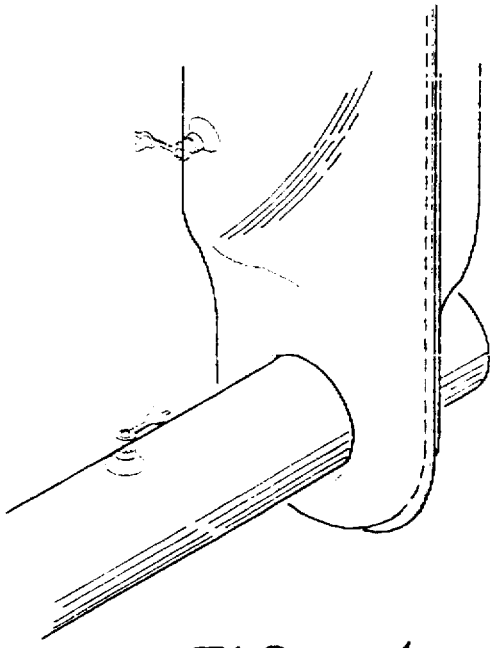
FIG. 4 is similar to FIG. 3 but showing the inflatable purlin fully inflated.
Figure 5:
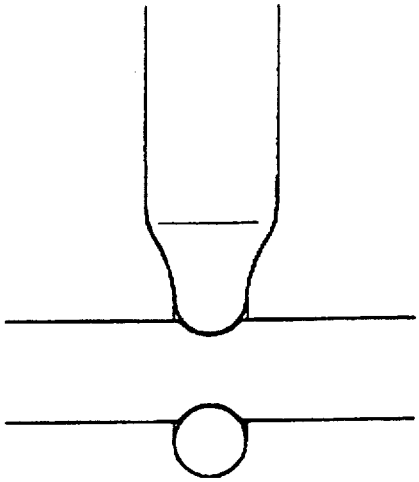
FIG. 5 is a sectional view of FIG. 4.
Figure 6:
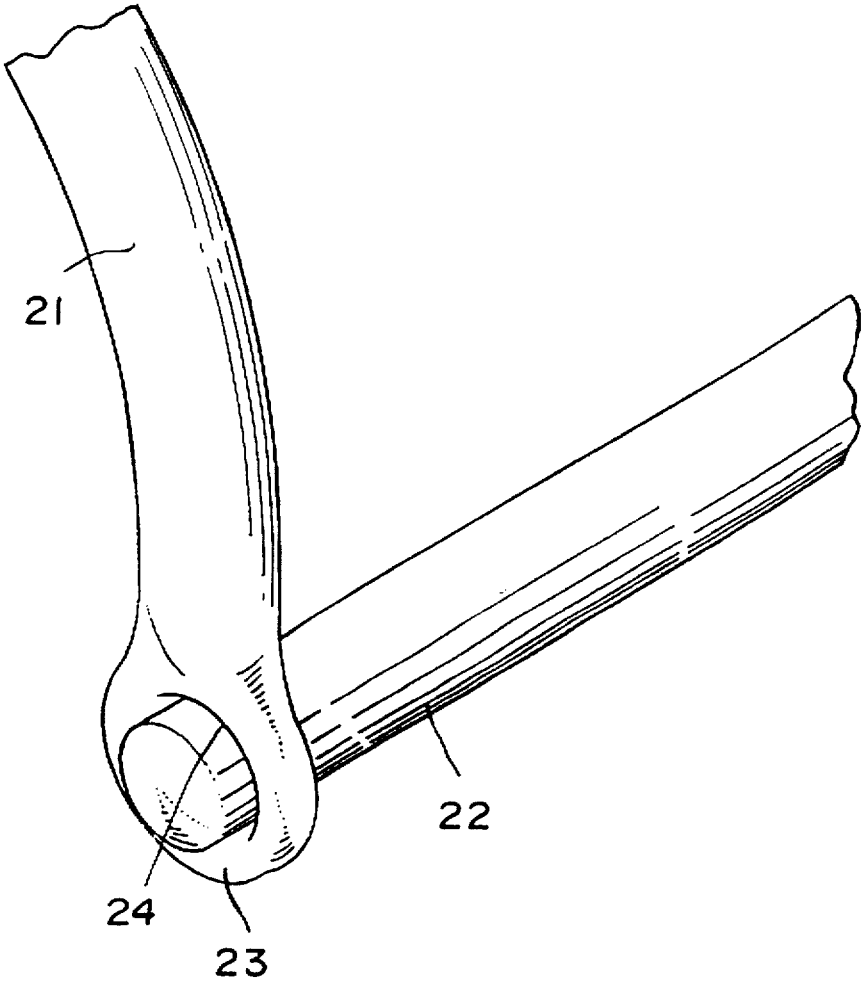
FIG. 6 is another assembly view of FIG. 2 but showing the inflatable purlin and the inflatable rafter fully inflated.
Figure 7:
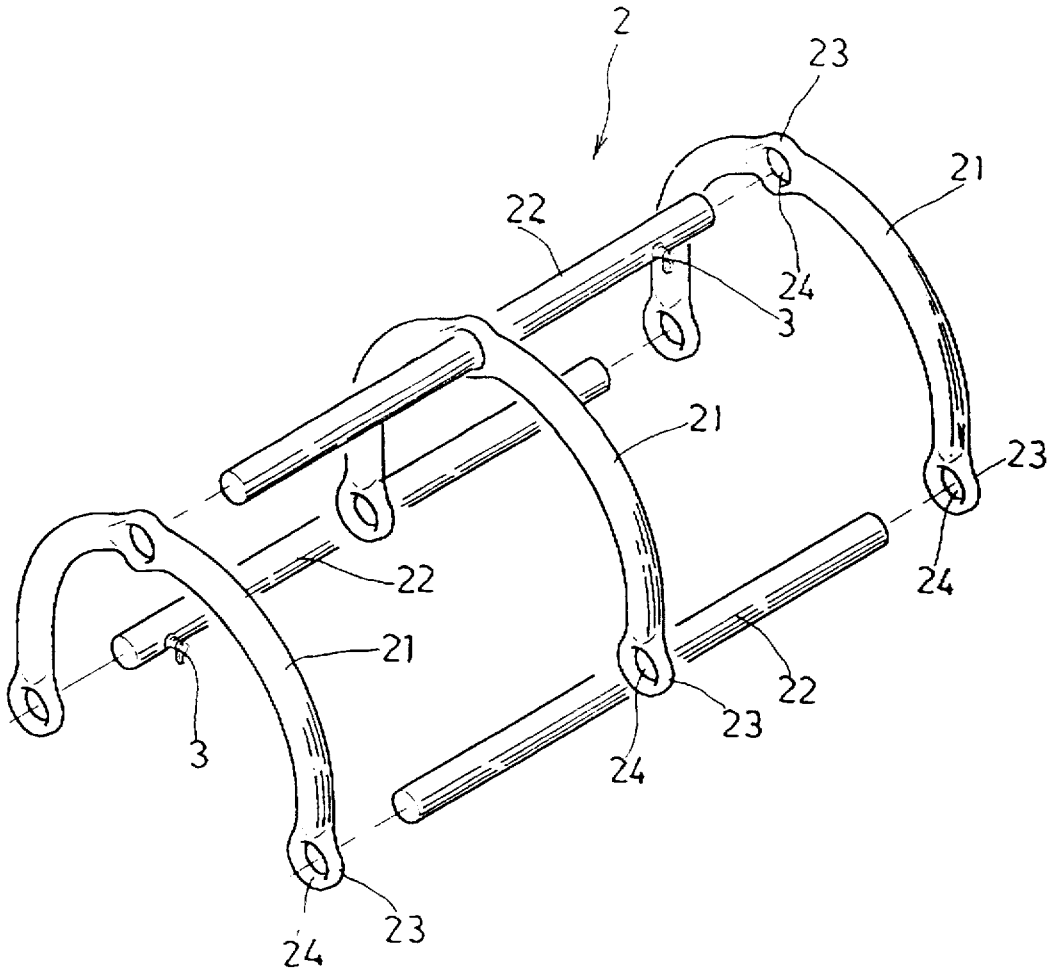
FIG. 7 is an exploded view of an inflatable frame structure according to one embodiment of the present invention.

Referring to FIGS. 2 and 7, the inflatable frame structure 2 is comprised of a plurality of inflatable purlins 22, and a plurality of inflatable rafters 21 connected in parallel by the inflatable purlins 22. The inflatable purlins 22 and the inflatable rafters 21 are respectively injection molded from strong plastic and can be inflated. Each of the inflatable rafters 21 comprises an air valve 3 through which the respective inflatable rafter is inflated, and a plurality of coupling portions 23. Each of the coupling portions 23 defines a coupling hole 24 for the insertion of one inflatable purlin 22. The inflatable rafters 21 can have an arched, rectangular, or polygonal shape, or any of a variety of shapes. The inflatable purlins 22 have a respective air valve 3 through which the respective inflatable purlin 22 is inflated.

Referring to Figures from 3 to 6 and FIG. 7 again, before the assembly process of the inflatable frame structure 2, the inflatable rafters 21 and the inflatable purlins 22 are partially inflated. When assembled, the inflatable rafters 21 and the inflatable purlins 22 are inflated to full extent so that the inflatable frame structure 2 is firmly retained in shape.

Figure 8:
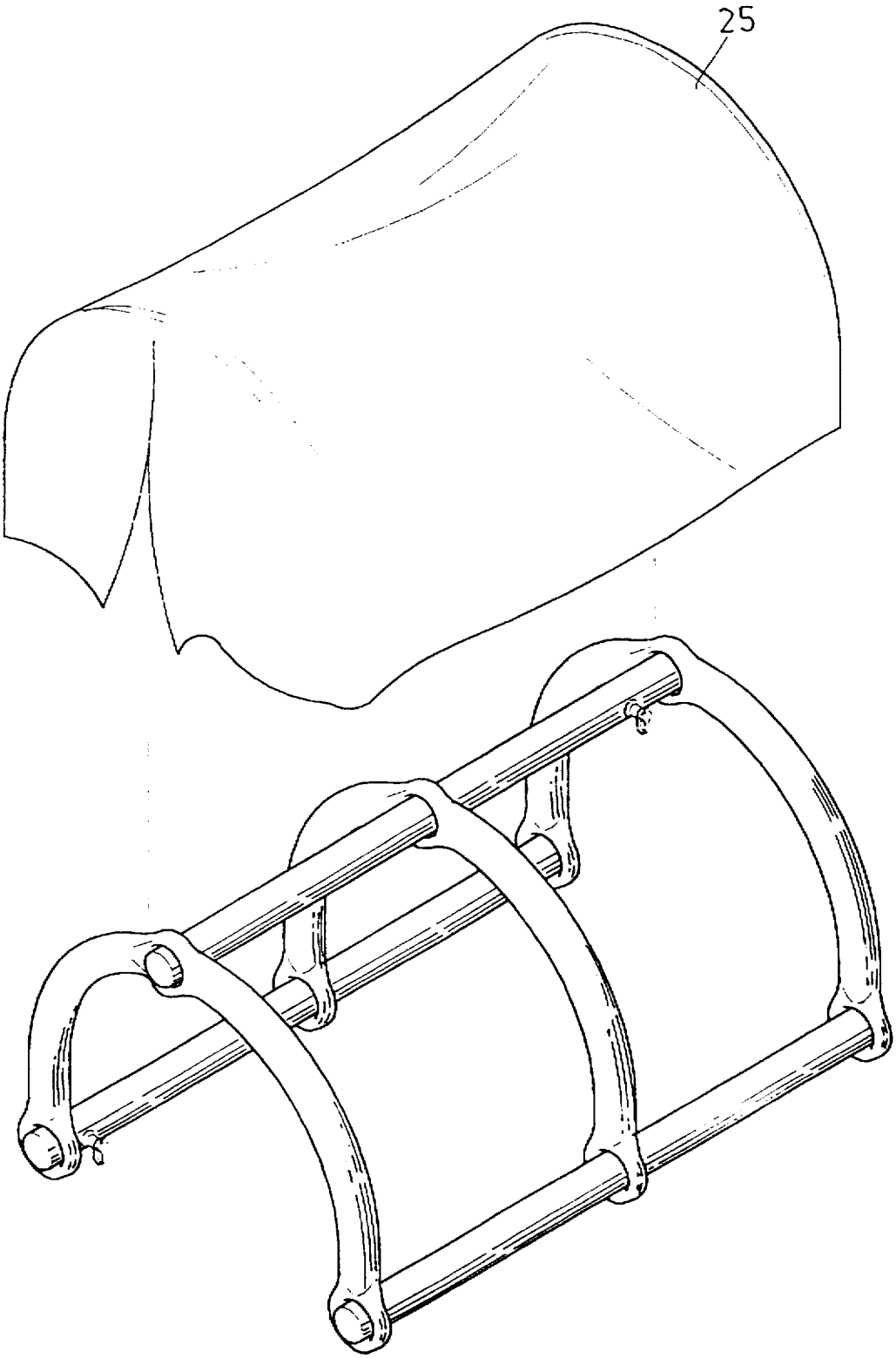
FIG. 8 is an assembly view of a shielding device according to one embodiment of the present invention before the installation of the covering.

In the embodiment shown in FIG. 7, the inflatable rafters 21 have a smoothly arched shape, and three coupling portions 23 with two disposed at two opposite ends and one in the middle; the inflatable purlins 22 are shaped like a round rod. When the inflatable purlins 22 are respectively inserted through the coupling holes 24 of the coupling portions 23 to connect the inflatable rafters 21 in parallel, the inflatable frame structure 2 is sell up. When the inflatable frame structure 2 is set up, a covering 15 is covered over the inflatable frame structure 2 to form a toy shield (see FIG. 8).

Figure 9:
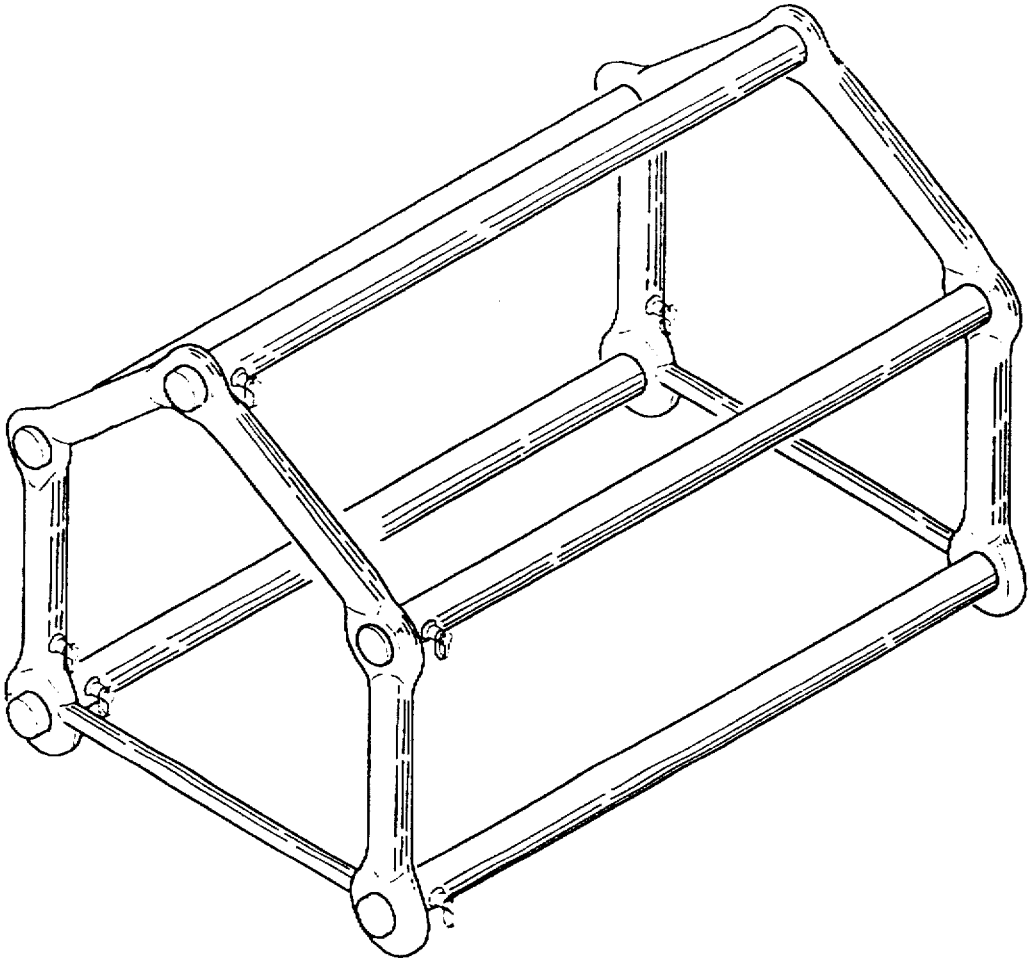
FIG. 9 is an elevational view of an alternate form of the inflatable frame structure according to the present invention.
Figure 10:
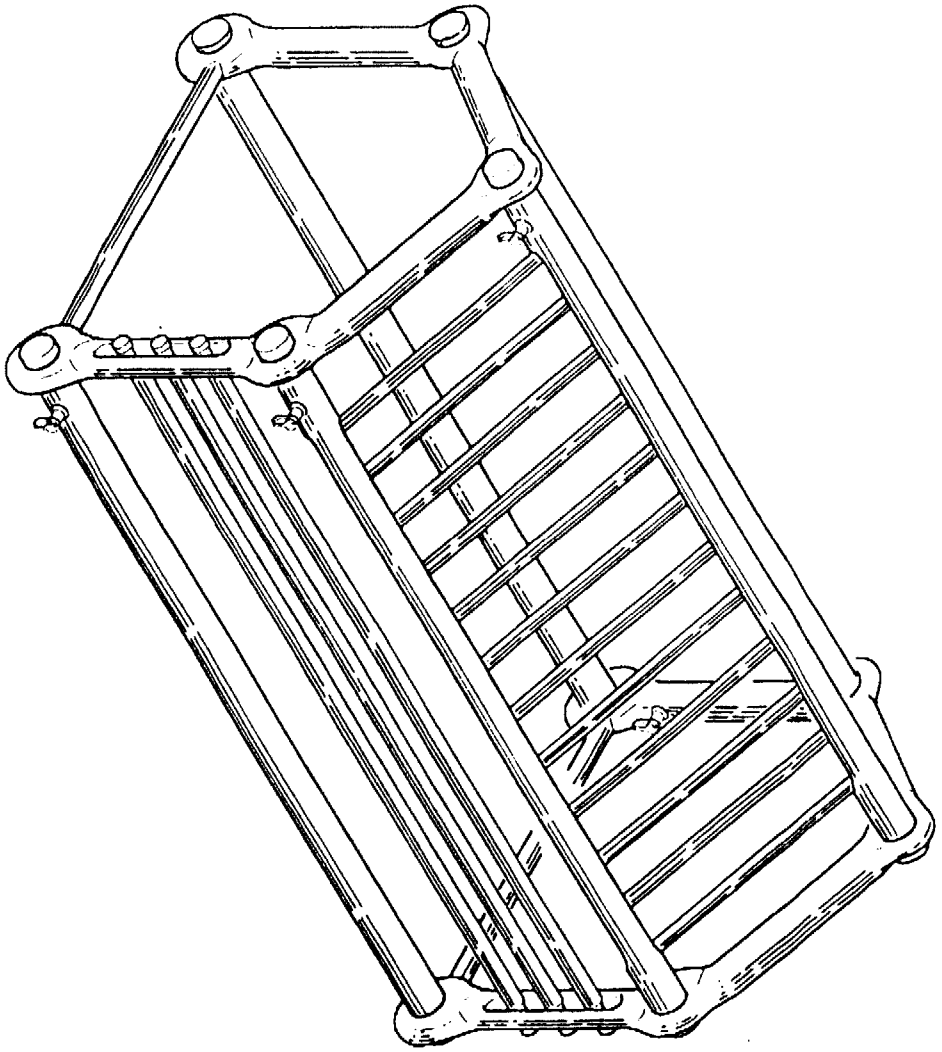
FIG. 10 is an elevational view of another alternate form of the inflatable frame structure according to the present invention.
Figure 11:
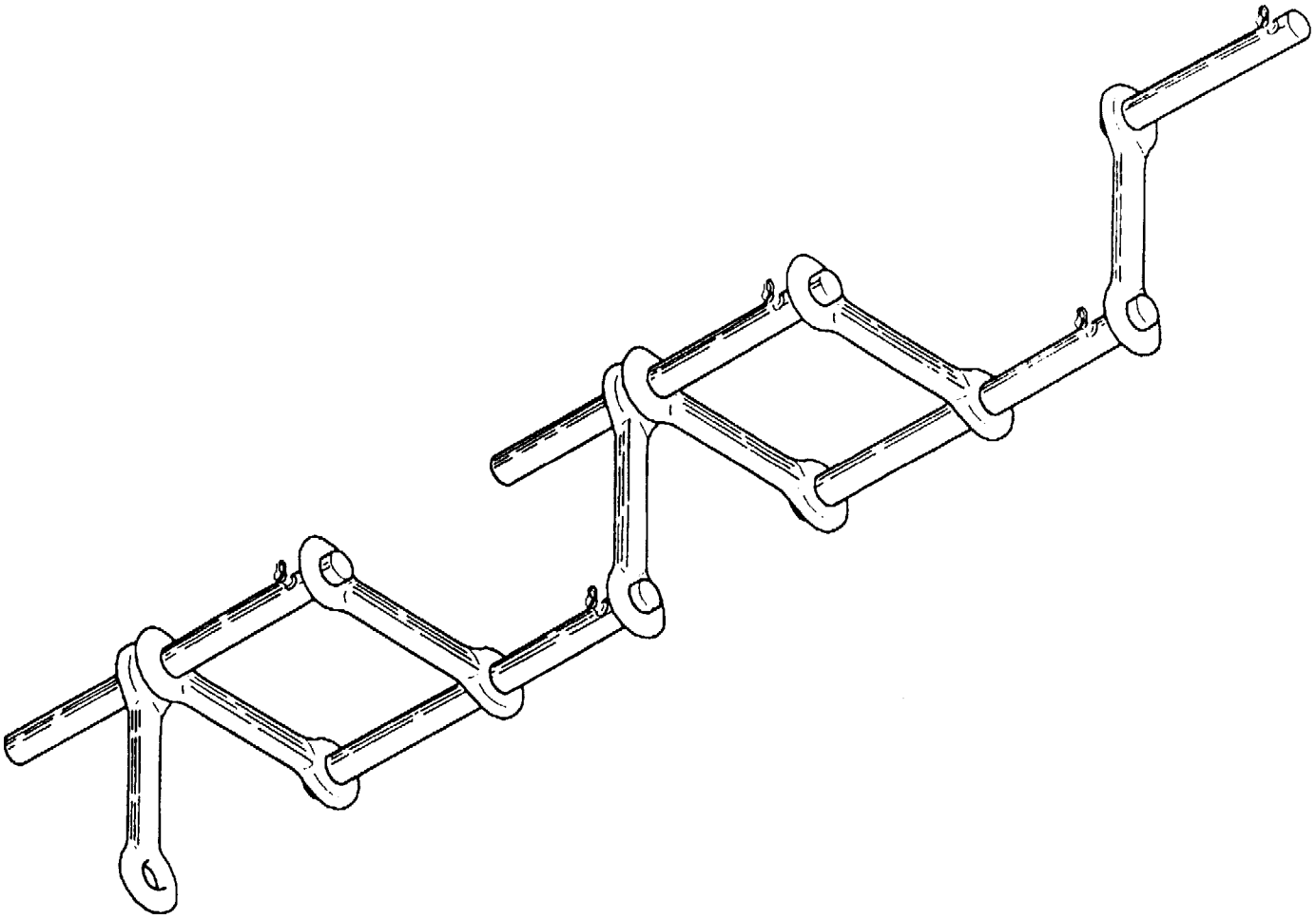
FIG. 11 shows a part of still another alternate form of the inflatable frame structure according to the present invention.

The inflatable rafters 21 and the inflatable purlins 22 may be variously shaped (see FIGS. from 9 to 11). As illustrated in FIG. 9, the inflatable rafters 21 have five sides and five angles, and the inflatable purlins 22 are shaped like a round rod. Further, the inflatable purlins 22 may be made having longitudinally spaced coupling portions so that inflatable connecting rods can be connected in parallel between two inflatable purlins 22 (see FIG. 10).

It is to be understood that the drawings are designed for purposes of illustration only, and are not intended as a definition of the limits and scope of the invention disclosed.

What is claimed is:

1. An inflatable shelter comprising:

a) a plurality of separate inflated rafters each located in a plane and spaced apart in a direction substantially perpendicular to said planes such that the rafters are substantially parallel and out of contact with each other, each rafter comprising a hollow interior and an inflating valve in communication with the hollow interior, each rafter further comprising at least three coupling holes;

b) a plurality of inflated purlins extending substantially perpendicular to the planes of the inflated rafters, each of the purlins extending completely through a coupling hole in each of the plurality of rafters, each purlin having a hollow interior and an inflating value in communication with the hollow interior, the engagements between the purlins and rafters forming a free-standing framework when inflated; and, c) a covering supported by the rafters and purlins.

2. The inflatable shelter of claim 1 wherein the inflated rafters have a semicircular configuration.

3. The inflatable shelter of claim 1 wherein the inflated rafters have a polygonal configuration.

* * * * *